US006851660B1

(12) United States Patent
Cravatt

(10) Patent No.: US 6,851,660 B1
(45) Date of Patent: Feb. 8, 2005

(54) LANDSCAPE TIMBER ANCHORING SYSTEM

(76) Inventor: Michael Thomas Cravatt, 7335 Brickyard Rd., Molino, FL (US) 32577

( * ) Notice: Subject to any disclaimer, the term of this patent is extended or adjusted under 35 U.S.C. 154(b) by 0 days.

(21) Appl. No.: 10/289,035

(22) Filed: Nov. 6, 2002

(51) Int. Cl.[7] ..... E01F 13/02; E04H 17/16

(52) U.S. Cl. ..... 256/19; 256/24; 256/65.11; 256/65.02; 256/73

(58) Field of Search ..... 256/12.5, 19, 24, 256/1, 73, 65.11, 65.02

(56) References Cited

U.S. PATENT DOCUMENTS

| | | | | | |
|---|---|---|---|---|---|
| 69,444 | A | | 10/1867 | Johnson | |
| 240,843 | A | | 5/1881 | Pontius | |
| 265,846 | A | | 10/1882 | McGee | |
| 398,078 | A | | 2/1889 | Peterson | |
| 813,971 | A | * | 2/1906 | Hinds | 256/19 |
| 1,331,117 | A | * | 2/1920 | Miller | 256/25 |
| 1,429,084 | A | * | 9/1922 | Loeffler | 256/19 |
| 1,845,791 | A | * | 2/1932 | Gray | 256/25 |
| 3,451,657 | A | | 6/1969 | Roberts | 256/19 |
| 3,486,287 | A | | 12/1969 | Guillon | 52/495 |
| 3,545,128 | A | | 12/1970 | Fontaine et al. | 47/33 |
| 3,700,213 | A | | 10/1972 | Blease | 256/19 |
| 4,540,160 | A | * | 9/1985 | Zanavich et al. | 256/19 |
| 4,735,397 | A | | 4/1988 | Degagne | 256/65 |
| 5,030,029 | A | * | 7/1991 | Johnsen | 256/66 |
| 5,078,367 | A | * | 1/1992 | Simpson et al. | 256/19 |
| D331,977 | S | * | 12/1992 | McGlothlen | D25/126 |
| 5,291,708 | A | | 3/1994 | Johnson | 52/282.2 |
| D386,652 | S | | 11/1997 | Rimback et al. | D8/1 |
| D407,161 | S | | 3/1999 | Daugherty et al. | D25/128 |
| 5,975,500 | A | | 11/1999 | Orton et al. | 256/19 |
| 6,017,019 | A | | 1/2000 | Erwin | 256/65 |
| 6,021,600 | A | | 2/2000 | Everett | 47/33 |

FOREIGN PATENT DOCUMENTS

| | | | |
|---|---|---|---|
| AU | 202672 A | * | 1/1956 |
| GB | 590047 A | * | 7/1947 |

OTHER PUBLICATIONS

BackYard Blitz, "Viva La Mexicana!", Jun. 10, 2001, web archive @ web.archive.org/web/20010610174107/www.burkesbackyard.com.au.blitz/vivalamex_b23.html, pp. 1–8.*

* cited by examiner

*Primary Examiner*—Daniel P. Stodola
*Assistant Examiner*—Ernesto Garcia
(74) *Attorney, Agent, or Firm*—Peter Loffler

(57) ABSTRACT

A landscape timber anchoring system uses a series of posts that each having openings that receive an end of a landscape timber. Pairs of posts are located in spaced apart fashion and the ends of the timbers are received within respective openings on the posts. Additional openings can be located above the initial openings to receive additional timbers in stacked fashion. Further openings can be disposed on the posts in an orientation that is different relative to the orientation of the first openings to receive an end of additional timbers with the opposing end of such timbers received within appropriate openings located on additional posts. Planks can be received within slits located on the posts in lieu of or in addition to the timbers.

9 Claims, 4 Drawing Sheets

LANDSCAPE TIMBER ANCHORING SYSTEM

BACKGROUND OF THE INVENTION

1. Field of the Invention

The present invention relates to system that allows for the precise placement, assembly, and anchoring of an entire landscape timber layout within a landscaping project.

2. Background of the Prior Art

Landscape timbers are used for their aesthetic as well as functional values. Landscape timbers help highlight areas of landscaping interest such as trees and flower gardens. As the timber itself tends to be a high quality wood that is chosen for its beauty and relationship to the landscaping for which it is intended, the timbers enhance the overall appeal of the landscaping project.

Additionally, the landscape timbers serve a functional value. A system of timbers can cordon off an area to prevent unwanted intrusion by, for example, people or horses. Additionally, the timbers are used to build up an area with the timbers serving to hold back and retain the soil in the built up area.

Landscape timbers are, by design, naturally very heavy and are relatively difficult to manipulate, making placement of such timbers into a desired position with a relatively high degree of accuracy desired within a high quality landscaping job very difficult. As the landscape timbers are supported by the soil upon which they rest, the landscape timbers tend to shift over time with the natural expansion and contraction of the soil.

Accordingly, landscape timber anchoring devices have been proposed. Such devices help to properly align the landscape timbers and hold them steady over time irrespective of the soil's desire to expand and contract. Such prior art devices, which work with varying degrees of efficiency tend to have one or more drawbacks. Some prior art devices are relatively complex in design and construction, making such devices expensive to manufacture and install and specifically making proper alignment of the timbers tricky. Other devices, which have a subterranean anchoring method, only allow a single timber to be anchored at a given spot and do not allow stacking of the timbers thereby limiting the height of the landscape timber structure that can be built. Still other devices only allow a very limited number of geometric shapes that can be built by the systems, which shapes tend to be rectangular.

Therefore, there exists a need in the art for a landscape timber anchoring system that overcomes the aforementioned needs in the art. Such a system must allow for relatively precise placement of landscape timbers within an overall landscape project that makes uses of the timbers and the system must be of relatively simple design and construction and must be relatively easy to install. Such a system must allow for landscape timber systems to be built more than one timber in height and must allow for a robust number to geometric shape to be built.

SUMMARY OF THE INVENTION

The landscape timber anchoring system of the present addresses the aforementioned needs in the art. The landscape timber anchoring system allows a user to be able to place landscape timbers with relative precision within an overall landscape project. The landscape timber anchoring system is of relatively simple design and construction and is relatively easy to install. The system allows for landscape timber systems to be built more than one timber in height and also allows for a robust number to geometric shapes to be achieved by the system.

The landscape timber anchoring system of the present invention is comprised of a first generally rectangular solid post that has a first opening, a second generally rectangular post that has a second opening, and a first landscape timber that has a first end that is received within the first opening and a second end that is received within the second opening. A third opening is disposed within the first post above the first opening, while a fourth opening is disposed within the second post above the second opening. A second landscape timber has a third end that is received within the third opening and a fourth end that is received within the second opening. The third opening is located no more than about ½ inch above the first opening and the fourth opening is located no more than about ½ inch above the second opening. The first post and the second post are each made from concrete and are of monolithic construction. A first generally vertically disposed slit is disposed within the first post while a second generally vertically disposed slit is disposed within the second post while at least one plank, such as a 2 inch by 6 inch plank has a first end that is received within the first slit and a second end that is received within the second slit. A fifth opening is disposed within the first post, the fifth opening facing in a direction that is different relative to the direction that the first opening faces and a third landscape timber is received within the fifth opening with its opposing end received within another post. A sixth opening is disposed within the second post, the sixth opening facing in a direction that is different relative to the direction that the second opening faces and a fourth landscape timber is received within the sixth opening with its opposing end received within another post. The fifth opening may be oriented in a generally perpendicular fashion relative to the first opening and the third opening or may be oriented in a generally opposite fashion relative to the first opening and the third opening. The sixth opening may be similarly or differentially oriented.

BRIEF DESCRIPTION OF THE DRAWINGS

Similar reference numerals refer to similar parts throughout the several views of the drawings.

DESCRIPTION OF THE PREFERRED EMBODIMENT

Figures 1, 2, 3, 4:
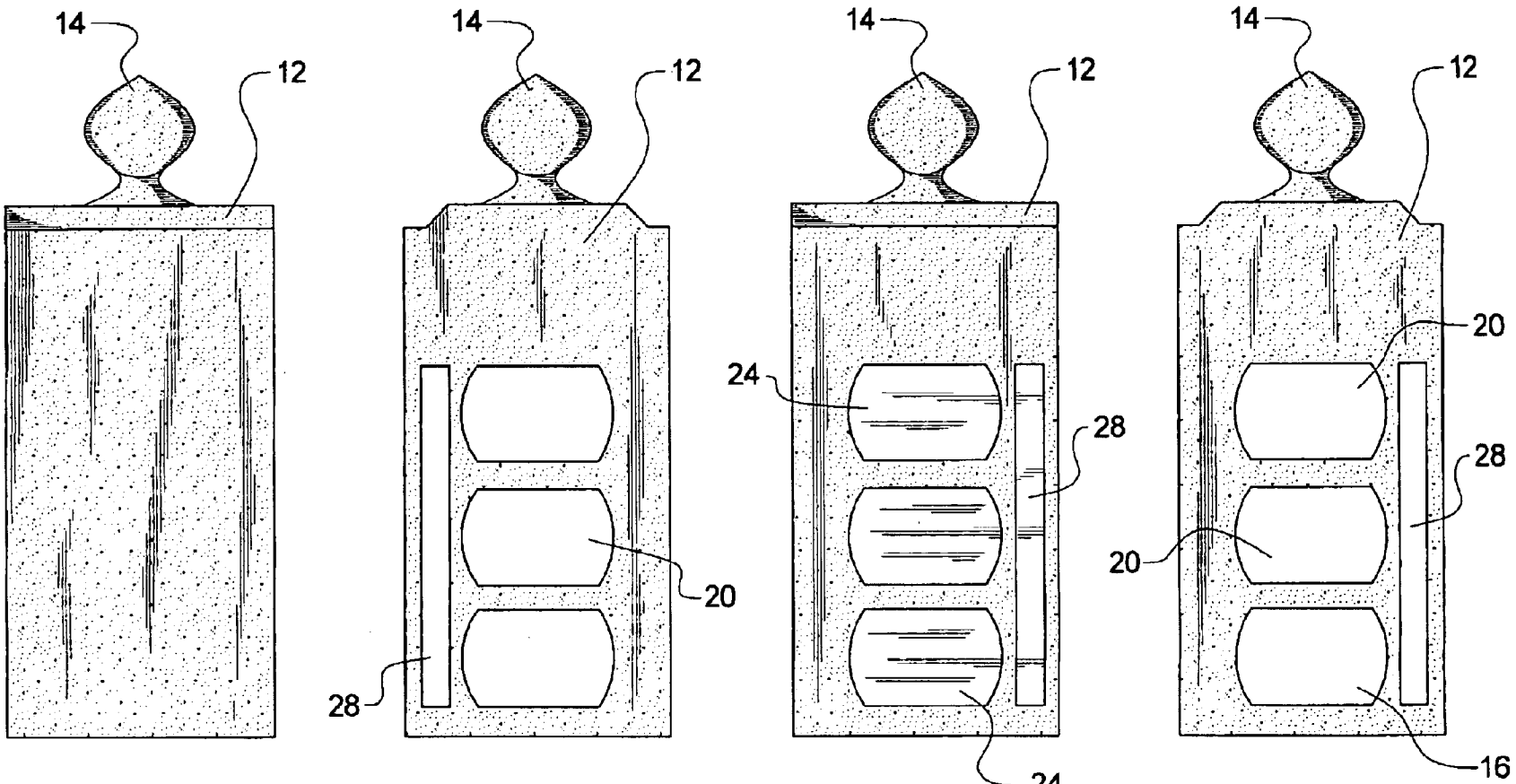
FIG. 1 is a front elevation view of a post of the landscape timber anchoring system of the present invention.
FIG. 2 is a right side elevation view of the post of the landscape timber anchoring system of the present invention.
FIG. 3 is a rear elevation view of the post of the landscape timber anchoring system of the present invention.
FIG. 4 is a left elevation view of the post of the landscape timber anchoring system of the present invention.

Referring now to the drawings, it is seen that the landscape timber anchoring system of the present invention, generally denoted by reference number 10, is comprised of at least a pair of posts 12. The posts 12 are made from concrete, are of monolithic construction, can be any shape including the illustrated rectangular solid shape, and can have ornamentation thereon such as the illustrated acorn topper 14, which may be positioned thereon or may be adhered or otherwise secured thereto in appropriate fashion. Each post 12 has a first opening 16 thereon such that when the two posts 12 are placed in spaced apart fashion with the openings 16 facing each other, the ends of a first landscape timber 18 are received within the openings 16 such that the timber 18 is in a generally horizontal orientation when the two posts 12 are seated relatively flat upon the ground G.

Additional openings 20 can be located on each post 12 directly above the first openings 16 so that additional landscape timbers 22 can be received within these additional openings 20 in order to allow vertical stacking of the landscape timbers 18 and 22. Advantageously, the adjacent vertically aligned openings will be separated by no more than about ½ inch in order to allow relatively tight stacking of the timbers 18 and 22 so that any soil or similar material being held back by the timbers 18 and 22 does not seep out from between the timbers 18 and 22.

Figure 5:
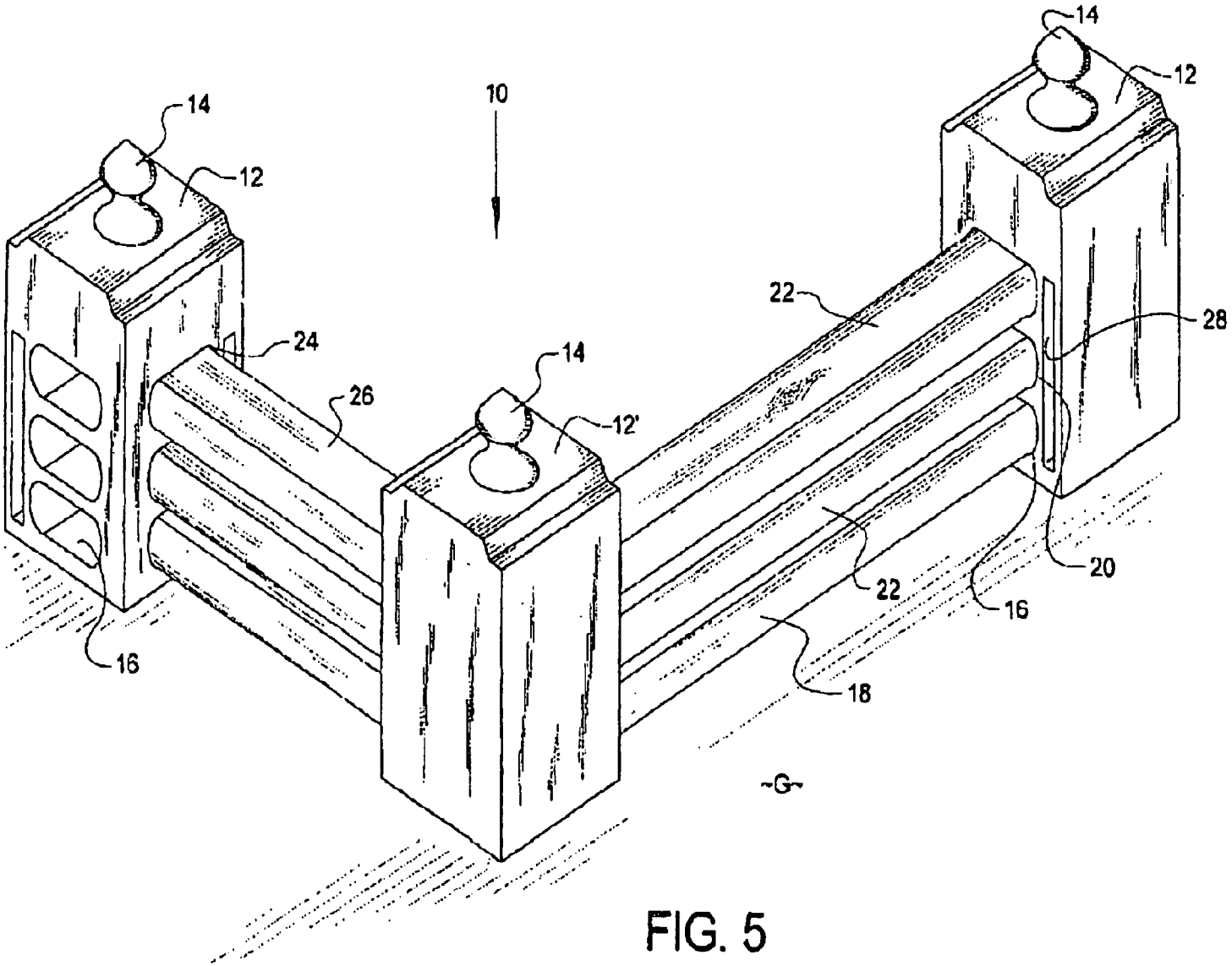
FIG. 5 is an environmental view of the landscape timber anchoring system of the present invention.
Figure 6:
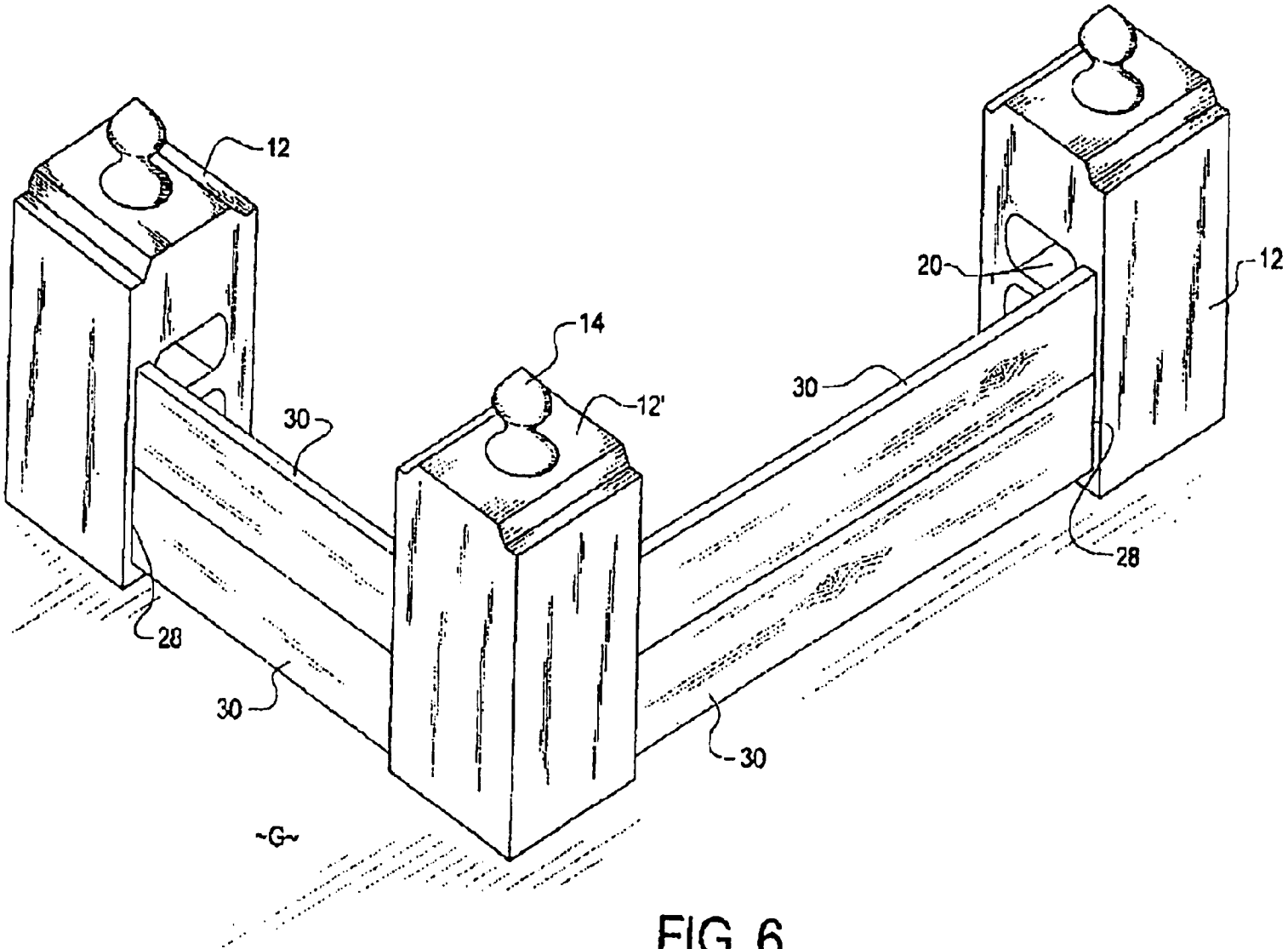
FIG. 6 is an alternate environmental view of the landscape timber anchoring system of the present invention utilizing planks.
Figure 7:
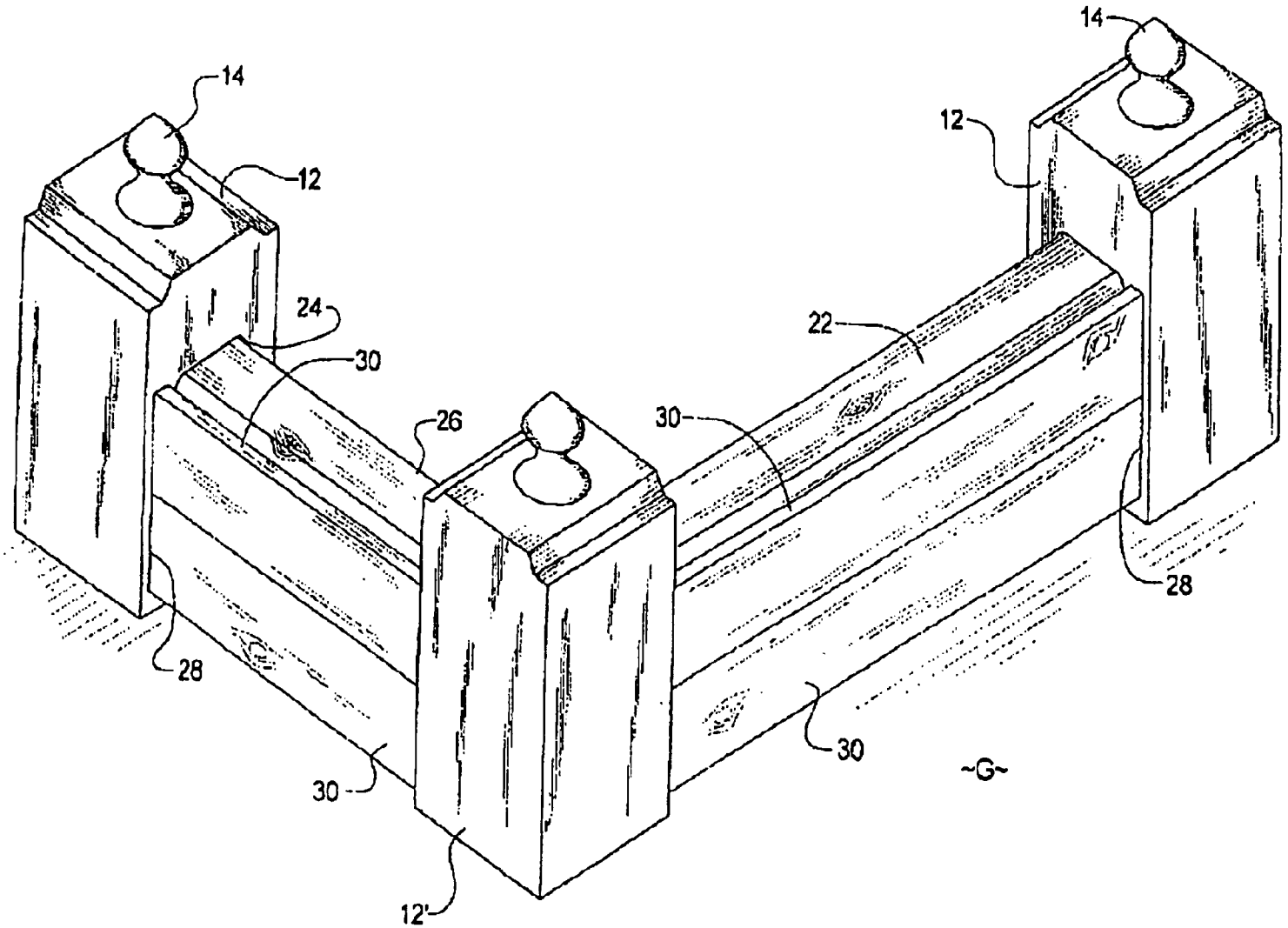
FIG. 7 is an environmental of the landscape timber anchoring system utilizing both timbers and planks.

Additional openings 24 can be located on the posts 12 such that these additional openings 24 face in a direction that is different relative to the direction faced by the first openings 16 as seen in post 12' in FIGS. 5–7. If the post 12 is a generally rectangular solid, these additional openings 24 can face in a direction that is either 90 degrees or 180 degrees separated from the original openings 16 or both. However, if the post 12 is of a different shape, such as a cylindrical solid, these additional openings 24 can be in any desired direction with respect to the first openings 16. These additional openings 24 receive additional timbers 26 which timbers are received in additional posts 12 and allow the landscape timber anchoring system 10 to delimit a three dimensional area.

A pair of generally vertically oriented slits 28 may be disposed on each post 12. Each slit 28 receives an end of one or more planks 30 such that when received, a side edge of the plank 30 faces toward the ground. The slits 28 may be used in lieu of the openings on one or more sides of the landscape timber anchoring system 10 when the primary purpose of that side is to retain soil or other similar material from escaping from within the perimeter of the landscape timber anchoring system 10.

In order to use the landscape timber anchoring system 10 of the present invention, two or more posts 12 are positioned on the ground G in spaced apart relation. One or more landscape timbers 18 and/or 22 is received within appropriate opening pairs of two posts 12. Additional timbers may be positioned between one or more other posts 12 until an overall desired system is built. If desired, on one or more sides of the system, planks 30 can be received within slits 28 on the two adjoining posts 12 as desired. The landscape timber anchoring system 10 allows an entire system to be built with relative ease and quickness and is very aesthetic in appearance.

While the invention has been particularly shown and described with reference to an embodiment thereof, it will be appreciated by those skilled in the art that various changes in form and detail may be made without departing from the spirit and scope of the invention.

I claim:

1. An anchoring system comprising:

a first post having a first opening, the first post made from concrete and seated on the ground and remains in an upright position without further anchoring of the first post to a ground;

a second post having a second opening, the second post made from concrete and seated on the ground and remains in an upright position without further anchoring of the second post to the ground;

a first landscape timber having a first end received within the first opening and a second end received within the second opening, such that the first landscape timber extends horizontally between the first post and the second post;

a first generally vertically disposed slit disposed within the first post, horizontally beside the first opening;

a second generally vertically disposed slit disposed within the second post, horizontally beside the second opening; and a first generally flat plank having a third end received within the first slit and a fourth end received within the second slit, such that the first plank extends horizontally between the first post and the second post.

2. The anchoring system as in claim 1 further comprising:

a third opening disposed within the first post above the first opening;

a fourth opening disposed within the second post above the second opening; and a second landscape timber having a third end received within the third opening and a fourth end received within the fourth opening, such that the second landscape timber extends horizontally between the first post and the second post.

3. The anchoring system as in claim 2 wherein the third opening is located no more than about ½ inch above the first opening and the fourth opening is located no more than about ½ inch above the second opening.

4. The anchoring system as in claim 1 wherein the first post is of monolithic construction and the second post is of monolithic construction.

5. The anchoring system as in claim 1 further comprising a second generally flat plank having a fifth end received within the first slit above the first plank and a sixth end received within the second slit above the first plank, such that the second plank timber extends horizontally between the first post and the second post.

6. The anchoring system as in claim 1 further comprising:

a third opening disposed within the first post, the third opening facing in a direction that is different relative to the direction that the first opening faces;

a third landscape timber received within the third opening;

a fourth opening disposed within the second post, the fourth opening facing in a direction that is different relative to the direction that the second opening faces; and a fourth landscape timber received within the fourth opening.

7. The anchoring system as in claim 6 wherein the third opening is oriented in a generally perpendicular fashion relative to the first opening and the fourth opening.

8. The anchoring system as in claim 6, wherein the third opening is oriented in a generally opposite fashion relative to the first opening and the fourth opening.

9. The anchoring system as in claim 1 wherein the first post and the second post are each generally rectangular solid in shape.

* * * * *